US006482272B2

(12) United States Patent
Kalina

(10) Patent No.: US 6,482,272 B2
(45) Date of Patent: Nov. 19, 2002

(54) METHOD OF PREVENTING NITRIDATION OR CARBURIZATION OF METALS

(76) Inventor: Alexander I. Kalina, 105 Glengarry Way, Hillsborough, CA (US) 94010

( * ) Notice: Subject to any disclaimer, the term of this patent is extended or adjusted under 35 U.S.C. 154(b) by 0 days.

(21) Appl. No.: 09/776,419

(22) Filed: Feb. 2, 2001

(65) Prior Publication Data

US 2001/0035232 A1 Nov. 1, 2001

Related U.S. Application Data

(60) Provisional application No. 60/179,987, filed on Feb. 3, 2000.

(51) Int. Cl.[7] ..... C23C 22/03; C23C 22/07; C23C 8/00

(52) U.S. Cl. ..... 148/214; 148/217

(58) Field of Search ..... 148/206, 217, 148/214

(56) References Cited

U.S. PATENT DOCUMENTS

| | | | | |
|---|---|---|---|---|
| 4,026,734 A | | 5/1977 | Manty | 148/6.15 R |
| 4,164,960 A | * | 8/1979 | Howard | |
| 4,216,034 A | | 8/1980 | Miyake et al. | 148/20.3 |
| 4,554,090 A | | 11/1985 | Jones | 252/191 |
| 5,462,634 A | | 10/1995 | Kamiyama et al. | 216/85 |

FOREIGN PATENT DOCUMENTS

| | | | |
|---|---|---|---|
| DE | 39 17 004 A1 | 11/1989 | C23C/8/04 |
| EP | 0 046 567 A | 3/1982 | C21D/1/76 |
| EP | 0 952 232 A | 10/1999 | C21D/1/76 |
| FR | 76 056 E | 1/1962 | |
| GB | 2 233 672 A | 1/1991 | C23C/8/18 |
| JP | 002165407 | 12/1984 | |

OTHER PUBLICATIONS

XP001012008 1977 "Equilibrium surface segregation of dissolved nonmetal atoms on iron (100) faces" article by H.J. Grabke et al. in Surface Science, in Amsterdam, NL.

XP001012213 1986 "Sulfur effects on the internal carburization of Fe–Ni–Cr alloys" article by J. Barnes et al. in Oxidation of Metals, in Petten, NL.

XP000026509 1989 "Thermodynamic Control of H2–N2 Bright Annealing Atmospheres to Inhibit Nitrogen Uptake By Stainless Steel" article by Kirner J. F. et al. in Journal of Heat Treating, in New York.

* cited by examiner

*Primary Examiner*—Roy King
*Assistant Examiner*—Harry D. Wilkins, III
(74) *Attorney, Agent, or Firm*—Robert W. Strozier

(57) ABSTRACT

A method is disclosed for prevention nitridation or carburization of metal surfaces in contact with a fluid including nitriding agents or carburizing agents where the method involves adding to the fluid an effective amount a sulfur-containing compound and a phosphorus compound, where the amount of phosphorus-containing compound is less than the amount of sulfur-containing compound. The simultaneous addition of both a sulfur compound and a phosphorus compound prevents nitridation and/or carburization and sulfidation of the metal surfaces in contact with fluids containing nitriding and/or carburizing agents significantly increasing the metal's lifetime.

17 Claims, 5 Drawing Sheets

METHOD OF PREVENTING NITRIDATION OR CARBURIZATION OF METALS

RELATED APPLICATION

This application claims provisional priority to U.S. Provisional Application Ser. No. 60/179,987 filed Feb. 3, 2000.

BACKGROUND OF THE INVENTION

1. Field of the Invention

The present invention relates to a method for reducing and/or preventing nitridation and/or carburization of metal surfaces in contact with a fluid including nitrogen-containing compounds capable of nitriding the metal surfaces and/or carbon-containing compounds capable of carburizing the metal surfaces, where the method includes adding a preventative composition to the fluid and to surfaces so treated.

More particularly, the present invention relates to a method for reducing and/or preventing nitridation and/or carburization of metal surfaces in contact with a fluid including nitrogen-containing compounds capable of nitriding the metal surfaces and/or carbon-containing compounds capable of carburizing the metal surfaces, where the method includes adding a preventative composition including sulfur and phosphorus to the fluid and to surfaces so treated.

2. Description of the Related Art

It is known that ammonia in contact with a metal surface at an elevated temperature decomposes on the metal surface releasing atomic nitrogen. Atomic nitrogen, in turn, defuses into the metal, forming nitrides. This process, know as nitridation, drastically increase the hardness of the metal, and decreases its ductility, thus causing degradation of the metal's resistance to stresses and fatigue. In power systems utilizing a water-ammonia mixture at temperatures below about 800° F., nitridation does not occur because water acts as a temporary poison deactivating the catalytic properties of the metal. At higher temperatures, water loses the ability to deactivate the catalytic properties of the metal, and nitridation progresses. Moreover, the nitridation process increases rapidly with increasing temperature after the water loses the ability to deactivate the nitridation process.

Conventional ways to prevent nitridation using protective coatings are inapplicable in this case, because during the operation of power plants, equipment, especially vapor turbines are subjected to erosion of their surfaces by solid particles. Therefore, any coating would be removed after a relatively short time.

Similarly, in carbon-containing atmospheres at elevated temperatures, carburization of metal surface can occur. Carburization of metal surface also causes considerable difficulties because the introduction of carbon atoms into the metal lattice changes is properties increasing fatigue problems and other undesirable problems.

In both cases, nitridation and/or carburization, corrosion can occur only as a result of the decomposition of compounds containing nitrogen or carbon which are thought to be caused by the catalytic action of metal in contact with the compounds. Thus, it would represent a significant advancement in the art to have a method that prevents nitridation or carburization of metal surfaces in contact with atmosphere or fluids that cause nitridation or carburization of the metal surface.

SUMMARY OF THE INVENTION

The present invention provides a method of preventing nitridation and/or carburization of a metal surface in contact with fluids including a nitrogen-containing compound capable of nitriding the surface and/or carbon-containing compound capable of carburizing the surface. The method includes adding a composition to the fluid on a discrete or continuous basis in an amount sufficient to reduce or prevent nitridation and/or carburization of the metal surface. The composition comprises a compound or mixture of compounds having a higher affinity for the metal surface than the nitrogen-containing compound or carbon-containing compound. Preferably, the composition includes at least a sulfur-containing compound having the ability to deactivate or poison the catalytic sites on the metal surface that are thought to be responsible for nitridation and/or carburization, and particularly, a sulfur-containing compound and a phosphorus-containing compound.

The present invention provides a method of preventing nitridation and/or carburization of metal surfaces in contact with a fluid including a nitrogen-containing compound capable of nitriding a metal surface and/or a carbon-containing compound capable of carburizing the surface, where the method comprises adding, on a discrete or continuous basis, a composition including a sulfur-containing compound to the fluid in an amount sufficient to reduce or prevent nitridation and/or carburization of the metal surface.

The present invention provides a method of preventing nitridation and/or carburization of metal surfaces in contact with a fluid including a nitrogen-containing compound capable of nitriding a metal surface and/or a carbon-containing compound capable of carburizing the surface, where the method comprises adding, on a discrete or continuous basis, a composition including a sulfur-containing compound and a phosphorus-containing compound to the fluid in an amount sufficient to reduce or prevent nitridation and/or carburization of the metal surface.

The present invention provides a method of preventing nitridation of metal surfaces in contact with a fluid including a nitrogen-containing compound capable of nitriding a metal surface, where the method comprises adding, on a discrete or continuous basis, a composition including a sulfur-containing compound to the fluid in an amount sufficient to reduce or prevent nitridation of the metal surface.

The present invention provides a method of preventing nitridation of metal surfaces in contact with a fluid including a nitrogen-containing compound capable of nitriding a metal surface, where the method comprises adding, on a discrete or continuous basis, a composition including a sulfur-containing compound and a phosphorus-containing compound to the fluid in an amount sufficient to reduce or prevent nitridation of the metal surface.

The present invention provides a method of preventing carburization of metal surfaces in contact with a fluid including a carbon-containing compound capable of carburizing the surface, where the method comprises adding, on a discrete or continuous basis, a composition including a sulfur-containing compound to the fluid in an amount sufficient to reduce or prevent carburization of the metal surface.

The present invention provides a method of preventing carburization of metal surfaces in contact with a fluid including a carbon-containing compound capable of carburizing the surface, where the method comprises adding, on a discrete or continuous basis, a composition including a sulfur-containing compound and a phosphorus-containing compound to the fluid in an amount sufficient to reduce or prevent carburization of the metal surface.

The present invention also provides an apparatus for introducing a nitridation and/or carburization preventative composition into processing equipment in contact with a fluid including a nitrogen-containing compound capable of nitriding a metal surface and/or a carbon-containing compound capable of carburizing a metal surface in an amount sufficient to reduce or prevent nitridation and/or carburization of metal or metal surfaces of the equipment. The apparatus generally includes a reservoir of the composition and an injector system in fluid communication with the reservoir and the equipment for metering into the fluid a sufficient amount of the composition to prevent nitridation and/or carburization of the metal or metal surfaces.

The present invention also provides a metal surface treated with a nitridation and/or carburization preventative composition of the present invention.

DESCRIPTION OF THE DRAWINGS

The invention can be better understood with reference to the following detailed description together with the appended illustrative drawings in which like elements are numbered the same.

DEFINITIONS

Figure 1:
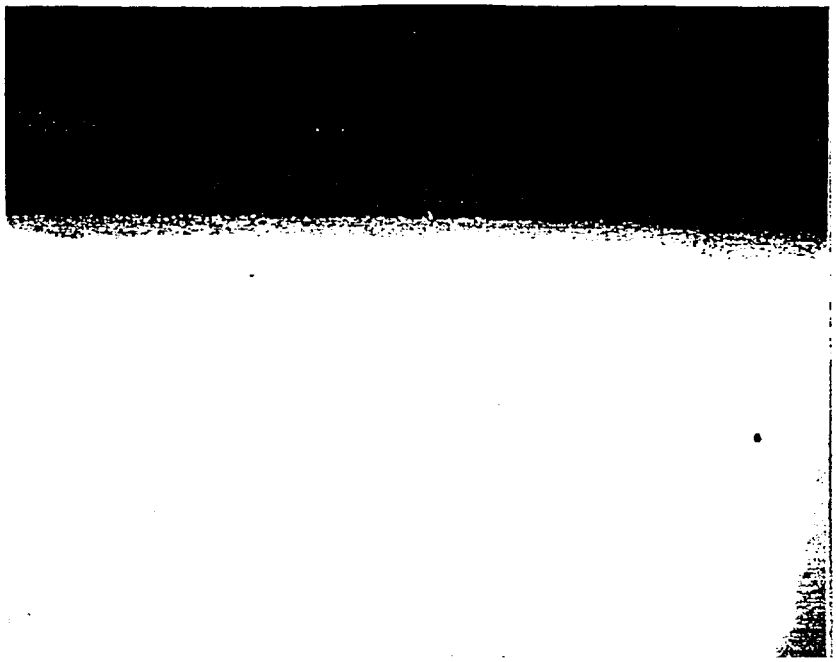
FIG. 1 is an X-ray microgram of metal sample A before to initial sulfidation.

The following term will have the following meaning when used in this application.

The term nitridation means the process in which atomic nitrogen becomes part of a metal or metal surface.

The term nitriding means the process of introducing atomic nitrogen into a metal or metal surface.

The term carburization means the process in which atomic carbon becomes part of a metal or metal surface.

The term carburizing means the process of introducing atomic carbon into a metal or metal surface.

The term sulfuric corrosion or sulfidation means a corrosive process involving the formation of metal sulfides, a process somewhat similar to oxidation converting the metal into salts, sulfide salts.

DETAILED DESCRIPTION OF THE INVENTION

The inventor has found that nitridation and/or carburization of metals or metal surfaces in contact with a fluid containing a nitrogen-containing compound capable of nitriding the metal surfaces and/or a carbon-containing compound capable of carburizing the metal or metal surfaces can be reduced or even totally prevented by adding an effective amount of a preventative composition to a fluid in contact with the metals or metal surfaces. The composition includes at least one compound having a high affinity for the metal surface than the nitrogen-containing and/or carbon-containing compounds. Preferably, the composition includes a sulfur-containing compound, for example hydrogen sulfide, $H_2S$, and particularly a sulfur-containing compound and a phosphorus-containing compound, for example ammonium phosphate and especially a phosphorus-containing compound.

The inventor has found that the interaction between sulfur and a metal surface or metals in general occurs by at least a two step process. Initially, sulfur is thought to chemisorb on the surface of the metal forming a partial or complete monolayer on the metal surface. Thereafter, formation of sulfides on the metal surface begins. The enthalpy of formation of such a monolayer is about −190 kJ/mol, whereas the enthalpy of formation of sulfides in the bulk metal is about −100 kJ/mol. See, e.g., J. Benard, J. Oudar, N. Barbouth, E. Margot and Y. Berthier, *Surf Sci.* 1979, 88, L35. Thus, the sulfur potential for the formation of the chemisorbed monolayer, partial or complete, on the metal surface is significantly more energetically favorable than the formation of sulfides in the bulk metal.

The inventor has found that a chemisorbed sulfur-containing monolayer (partial or complete) deactivates sites on the metal surface which are thought to be catalytically active in the conversion of nitrogen-containing compounds to atomic nitrogen and carbon-containing compounds to atomic carbon on the metal surface. The formation of atomic nitrogen on the surface of the metal is then thought to lead to nitridation of the metal itself with concurrent changes in physical properties of the metal. The same is true for the formation of atomic carbon. The chemisorbed sulfur-containing monolayer reduces to substantially completely prevents nitridation and/or carburization of a metal surface by rendering its catalytic sites inactive (i.e., poisoning the sites). Thus, in accordance with the present invention, the preventative compositions are designed to deactivate (poison) or cover the catalytic sites on a metal surface that enable the decomposition of nitrogen and/or carbon bearing compounds. This prevents the decomposition which would otherwise result in nitridation and/or carburization.

Although sulfur-containing compounds are good nitridation and carburization preventatives, the potential of sulfur-containing compounds to form metal sulfides, a form of sulfuric corrosion, limits the universal applicability of such preventative compositions of the present invention that include only sulfur-containing compounds. However, the inventor has also found that sulfuric corrosion can be avoided if the concentration of sulfur-containing compounds in the fluid, such as an atmosphere, is kept below a sulfidation threshold level. Consequently, the useable concentrations of sulfur-containing compounds will be very low making formation of a protective chemisorbed sulfur compound monolayer slow. As a result, nitridation will occur, though at a reduced rate.

Surprisingly, the inventor has found compositions that not only inhibits nitridation and/or carburization of metals or metal surfaces, but also inhibit sulfidation or sulfuric corrosion when sulfur is used to prevent nitridation and/or carburization of metals or metal surfaces in contact with a fluid including an atmosphere containing a nitrogen-containing compound such as ammonia and especially water-ammonia mixtures or a carbon-containing compound such as a carbon oxide or hydrocarbon. The inventor has found that by adding a secondary component along with the sulfur-containing compound, a composition can be formulated that substantially completely eliminates nitridation and/or carburization of metals or metal surface in nitriding and/or carburizing environments. The secondary component is generally characterized by having a greater potential for interacting with the metal surface than sulfur-containing compounds so that sulfidation is suppressed. The preferred secondary component is a phosphorus-containing compound.

The inventor has experimentally established that adding a phosphorus compound to a water-ammonia atmosphere containing a sulfur compound effectively prevents nitridation and sulfidation of a metal surface in contact with the atmosphere. The concentration of phosphorus-containing compounds should be sufficient to prevent sulfidation, but not so high as to prevent the sulfur-containing compound from preventing nitridation. It is thought that the concentration of phosphorus-containing compound must be less than the concentration that inhibits, interferes with or stops the formation of a chemisorbed sulfur monolayer on the metal surface.

Generally, the amount of sulfur-containing compounds present in the fluid is between about 5 ppm and about 50 ppm, preferably between about 10 ppm and about 40 ppm and particularly between about 15 ppm and about 25 ppm. Of course, higher or lower amounts can be used if desired provided that the amount is effective in preventing nitridation and/or carburization. Generally, the amount of phosphorus-containing compound used in conjunction with the sulfur-containing compound is between about 1 and about 1/100 (0.01) times the weight percent added sulfur-containing compound, preferably the amount is between about ½ (0.5) and about 1/50 (0.02) times the weight percent added sulfur-containing compound, and particularly the amount is between about ¼ (0.25) and about 1/20 (0.05) times the weight percent added sulfur-containing compound. Of course, greater and lesser amounts can be used if desired provided the two component system effectively prevents nitridation and/or carburization and simultaneously prevents sulfuric corrosion. In terms of ppms, the phosphorus-containing compound generally should be added in an amount between about 0.01 ppm to about 10 ppm, preferably between about 0.05 ppm and about 5 ppm, particularly, between about 0.05 ppm and about 2 ppm and especially between about 0.1 ppm and about 1 ppm.

By surface, the inventor means the atoms or sites on the surface and the atoms or sites about 1 to about 10 atomic or molecular layers below the surface. Thus, the nitriding or carburizing compounds can react with atoms or sites directly on the surface or near the surface (slightly below the actual surface). An ordinary artisan should recognize that surfaces generally have holes, breaks, cracks, crevices or the like associated therewith and the surface modifying agents would be expected to react anywhere on the surface accessibe to the surface modifying agents. The inventor, therefore, is not limiting the reaction involved in nitridation, carburization or sulfidation to atoms or sites forming the interface between the surfaces of an object and its surroundings.

Suitable nitrogen-containing compounds capable of nitriding a metal surface include, without limitation, ammonia, primary amines—$RNH_2$ where R is a C1 to C20 carbon-containing group including alkyl, aryl, alkaryl, aralkyl or the like, secondary amines—$R_2NH$ where each R is the same or different and is a C1 to C20 carbon-containing group including alkyl, aryl, alkaryl, aralkyl or the like, tertiary amines—$R_3N$ where each R is the same or different and is a C1 to C20 carbon-containing group including alkyl, aryl, alkaryl, aralkyl or the like where or any other nitrogen-containing compound that under certain conditions will interact with a metal surface to form atomic nitrogen that will in turn nitride the metal, or mixtures or combinations thereof.

Suitable carbon-containing compounds include, without limitation, carbon oxides such as carbon monoxide and carbon dioxide, hydrocarbons such as alkanes, alkenes, alkynes, aromatic ring systems, non-aromatic ring systems or any other carbon-containing compound capable of carburizing a metal or metal surface, or mixtures or combinations thereof.

Suitable sulfur-containing compounds for use in the inhibitor compositions of this invention include, without limitation, sulfur, hydrogen sulfide, sulfide salts such as ammonium sulfide, alkali metal sulfides, alkaline metal sulfides, sulfides having organic counter ions, or the like, thiols—RSH where R is a C1 to C20 carbon-containing group including alkyl, aryl, alkaryl, aralkyl or the like, disulfides—RSSR where each R is the same or different and is a C1 to C20 carbon-containing group including alkyl, aryl, alkaryl, aralkyl or the like, disulfide salts—RSSZ where R is a C1 to C20 carbon-containing group including alkyl, aryl, alkaryl, aralkyl or the like and Z is ammonium, an alkali metal, an alkaline metal or an organic counterion, polysulfides—$RS_iR$ where each R is the same or different and is a C1 to C20 carbon-containing group including alkyl, aryl, alkaryl, aralkyl or the like and i is an integer having a value greater than 2 and generally less than about 20, polysulfide salts—$RS_iZ$ where R is a C1 to C20 carbon-containing group including alkyl, aryl, alkaryl, aralkyl or the like, i is an integer having a value greater than 2 and generally less than about 20 and Z is ammonium, an alkali metal, an alkaline metal or an organic counterion or other sulfur compounds capable of sulfidizing a metal surface, or mixtures or combinations thereof.

Suitable phosphorus-containing compounds for use in the inhibitor compositions of this invention include, without limitation, phosphorus, phosphines such as $PH_3$, $PRH_2$, $PR_2H$, and $R_3P$ where each R is the same or different and is a C1 to C20 carbon-containing group including alkyl, aryl, alkaryl, aralkyl or the like, phosphites such as ammonium phosphites, alkali metal phosphites, alkaline metal phosphites, phosphites having organic counter ions, or the like, phosphates such as ammonium phosphates, alkali metal phosphates, alkaline metal phosphates, phosphates having organic counter ions, or the like, pyrophosphates such as ammonium pyrophosphates, alkali metal pyrophosphates, alkaline metal pyrophosphates, pyrophosphates having organic counter ions, or the like, polyphosphates such as ammonium polyphosphates, alkali metal polyphosphates, alkaline metal polyphosphates, polyphosphates having organic counter ions, or the like or other phosphorus-containing compounds capable of inhibiting sulfuric corrosion of metal surfaces, or mixtures or combinations thereof.

Other compound suitable for use in the inhibitor compositions of this invention include, without limitation, thiophosphates, thiophoshites, or other compounds-containing phosphorus and sulfur which act to inhibit nitridation of metal surfaces in contact with a fluid containing a nitrogen-containing compound capable of nitriding the metal surfaces, or mixtures or combinations thereof.

Suitable fluids include, without limitation, aqueous fluids such as water-ammonia atmospheres used in power generating equipment, any other aqueous fluid (gas or liquid or mixtures thereof) environments containing nitriding or carburizing reagents, or non-aqueous fluids such as solutions containing non-aqueous solvents or solvent systems including, without limitation, hydrocarbon solvents (alkane, alkene, alkyne, aromatic or non-aromatic ring solvents), alcohol solvents, halogenated solvents, hetero atom containing solvents, or any other solvent or mixed fluids including an aqueous phase and a non-aqueous phase, or mixture or combinations thereof where nitridation and/or carburization of metals or metal surfaces is a concern.

Of course, the choice of a particular sulfur-containing compound and its associated phosphorus-containing compound will depend at least on the metal surface to be protected, the physical conditions associated with the process such as temperature, pressure, etc., the chemical composition of the fluid containing the nitrogen-containing compound and/or carbon-containing compound and the solubility of the compounds in the fluid. For water-ammonia mixtures (nitriding fluids), the sulfur and phosphorus-containing compounds should be soluble enough in the mixture to ensure that a sufficient amount to prevent nitridation and sulfuric corrosion the compounds are present in the fluid without precipitation problems. The preferred sulfur-containing compound is hydrogen sulfide, while the preferred phosphorus-containing compound is ammonium phosphate because it add only phosphate to the system.

For non-aqueous environments, the choice of sulfur and phosphorus compounds will again depend at least on the metal surface to be protected, the physical conditions associated with the process such as temperature, pressure, etc., the chemical composition of the fluid containing the nitrogen-containing compound and/or carbon-containing compound and the solubility of the compounds in the fluid. Again, the preferred sulfur containing compound is hydrogen sulfide, but lower thiols are equally as effective. However, the phosphorus-containing compound is phosphine ($PH_3$) or lower alkyl phosphines.

For water-ammonia atmospheres, suitable operating conditions for the method of the present invention are temperatures generally greater than about 800° F. and preferably between about 800° F. and about 2000° F. and particularly between about 800° F. and about 1500° F. and especially between about 800° F. and about 1100° F.

For fluid that do not contain water, suitable operating temperatures are any temperature at which nitridation and/or carburization of a given metal surface can occur. Generally the temperature can range from near absolute zero on the Kelvin scale to temperatures sufficient to melt the metal surface to be protected. Because the catalytic sites responsible for nitridation and/or carburization can be activated by means other than temperature (light, radiation, ion and molecular beams or the like), the use of the compositions of the present invention can prevent nitridation and/or carburization under any of these conditions. If the compositions of the present invention are to be used in a refinery setting, then the temperature range will generally be room temperature or greater. For most refinery reactions the temperature is preferably between about 300° F. and about 2000° F. and particularly between about 300° F. and about 1 500° F. and especially between about 300° F. and about 110° F.

Suitable operating pressures are generally atmospheric pressure (14.67 psia) and above. However, the method of this invention can also be adapted to subatmospheric pressures commonly used in industry. Preferably, the operating pressure is between about 10 mm HG and about 10,000 psia and particularly between about 15 psia (atmospheric pressure) and about 5,000 psia and especially between about 100 psia and about 1,000 psia.

EXAMPLES

The following examples illustrate the inhibiting properties of the compositions of the present invention. In all of the examples, the metal samples used was 12% chromium steel.

Five substantially identical metal samples were pretreated as follows:

Sample A was exposed to an atmosphere of steam containing 66 ppm $H_2S$ and approximately 2 ppm of phosphorus in the form of phosphorus pentoxide $P_2O_5$, for 24 hours at a temperature of 1050° F. and a pressure for 500 psia.

Sample B was soaked in a solution of $H_2S$ in hexane.

Sample C was soaked in a solution of phosphine, $PH_3$ in hexane.

Sample D was not pre-treated.

Sample E, used as a reference, was exposed to an atmosphere of steam at a temperature of 1050° F. for approximately 3 hours.

Samples A–D were then placed in a testing chamber. A gas mixture containing 80 wt % ammonia in water and 20 ppm of $H_2S$ and approximately 2 ppm of phosphorus, in the form of phosphorus pentoxide, was circulated through the chamber at a temperature of 1050° F. and a pressure of 500 psia for a period of 300 hours. Thereafter, the metal samples were removed from the testing chamber and subjected to mechanical testing and metallographical analysis.

The results of the mechanical or tensile testing are presented in the table below:

TABLE I

| Metal Properties | | | | |
|---|---|---|---|---|
| SAMPLE ID | DIAMETER (inches) | YS/UTS (KSI) | % EL | % RA |
| A | 0.250 | 129.3/148.7 | 15 | 40.5 |
| B | 0.250 | 130.3/149.5 | 17 | 51.7 |
| C | 0.251 | 128.5/148.6 | 14 | 37.0 |
| D | 0.251 | 129.6/150.2 | 17 | 52.4 |
| E | 0.251 | 131.6/151.0 | 18 | 54.6 |

YS - Yield Strength
UTS - Ultimate Tensile Strength
% EL - % change in elongation
% RA - % reduction of area.

It is well-known in the art that untreated samples of 12% chromium steel have %Elongations that vary from about 17% to about 18% and %RA that vary from about 50 to about 55%. Thus, Samples B and D did not suffer any degradation in their mechanical properties, whereas Samples A and D showed measurable degradation, especially loss of ductility.

An Energy Dispersive X-Ray (EDX) Microprobe analysis was performed on the surfaces of all of the samples with the following results:

Sample A showed a 3.51% surface content of phosphorus.

Sample B showed a 5.41% surface content of phosphorus.

Sample C showed a 11.42% surface content of phosphorus.

Sample D showed a 5.23% surface content of phosphorus.

All samples, with no exception, showed no detectable presence of sulfur on their respective surfaces.

Figure 2:
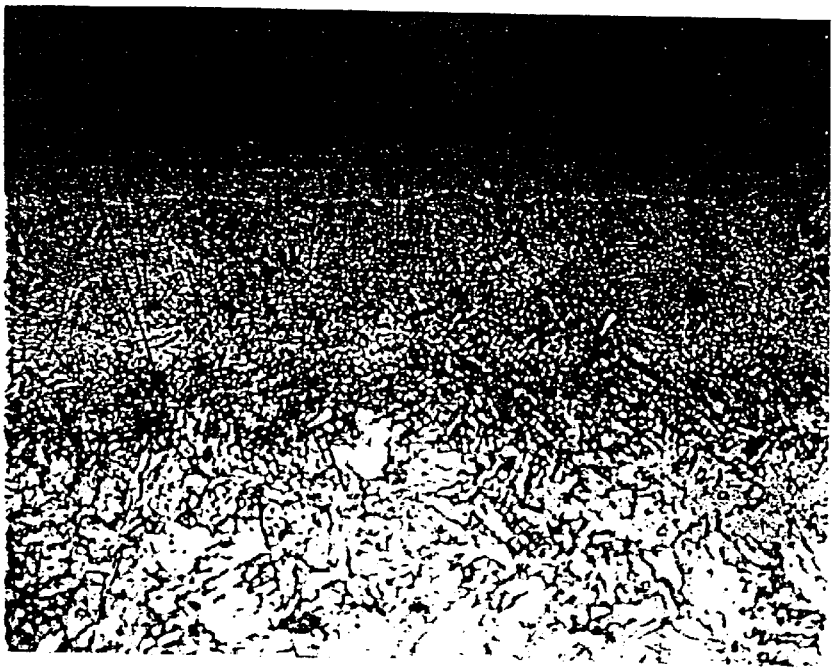
FIG. 2 is an X-ray microgram of metal sample A after treatment.

Sample A suffered significant sulfuric corrosion as a result of exposure, for 24 hours, to an atmosphere containing 66 ppm of $H_2S$ as shown in FIG. 1. Further exposure to an atmosphere containing 20 ppm of $H_2S$ and approximately 2 ppm phosphorus stopped sulfidation, which is demonstrated by the fact that there was no trace of sulfur on the surface of the sample FIG. 2.

Figure 5:
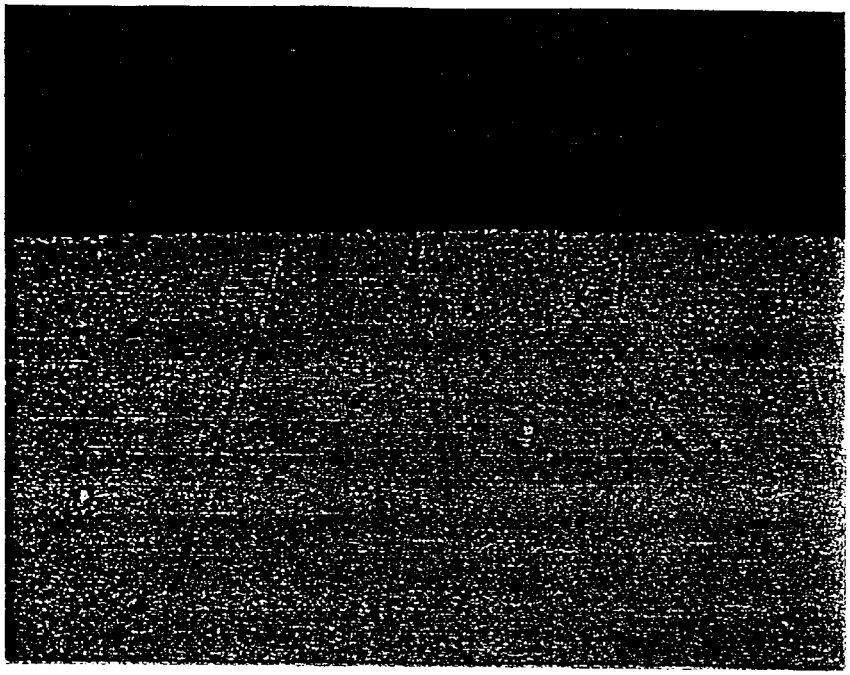
FIG. 5 is an X-ray microgram of metal sample D before treatment.
Figure 6:
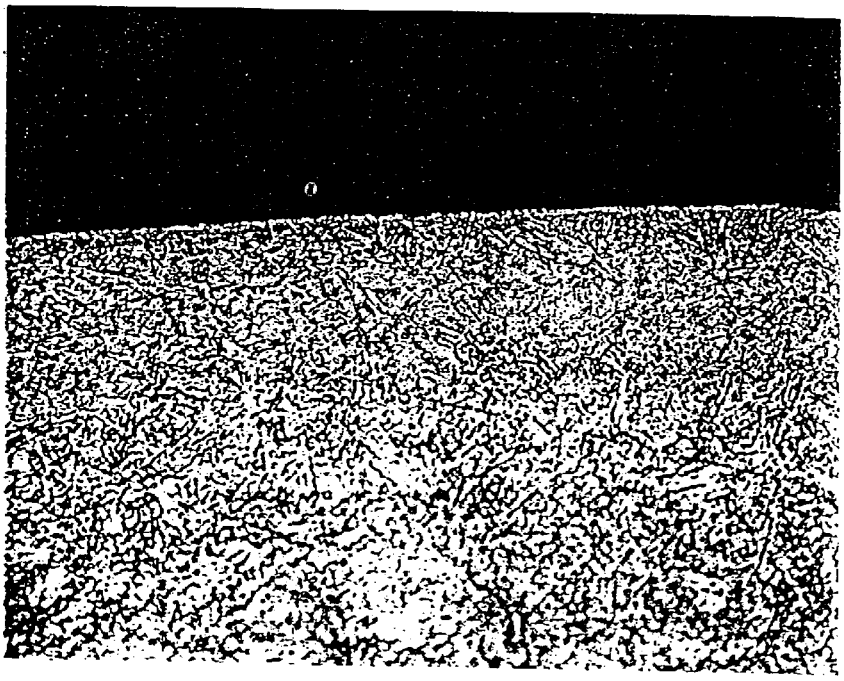
FIG. 6 is an X-ray microgram of metal sample D after treatment.

Sample B and Sample D showed no traces of sulfuric corrosion and no traces of nitridation by decomposed ammonia. Micrograms of Sample D are shown in FIGS. 5 and 6. This shows that the presence of phosphorus prevented the formation of sulfides, but did not prevent the formation of a chemisorbed monolayer of sulfur which is known to prevent nitridation. See H. J. Gradke, W. Paulitschke, G. Tauber and H. Viefhaus, *Surf Sci.,* 1977, 63, 377.

Samples B and D are thought to have initially formed a chemisorbed sulfur layer which prevented nitridation, but the samples did not suffer any sulfidation attack and had no deposition of sulfur compounds on their surfaces. This is a result of the fact that the phosphorus potential was lower than the sulfur potential to form a chemisorbed monolayer, but higher than the sulfur potential to form metal sulfides.

Figure 3:
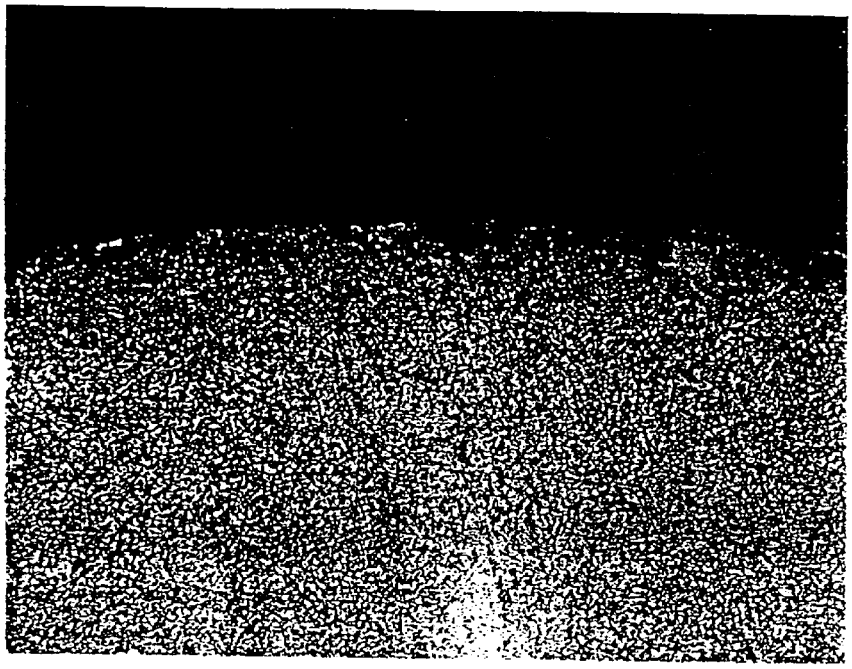
FIG. 3 is an X-ray microgram of metal sample C before treatment.
Figure 4:
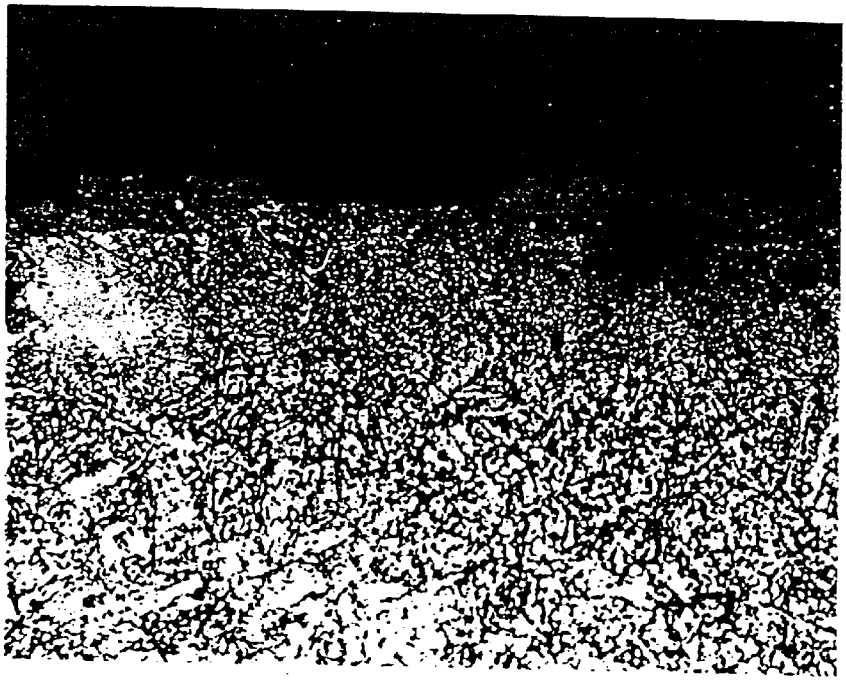
FIG. 4 is an X-ray microgram of metal sample C after treatment.

Sample C showed no traces of sulfuric corrosion, but was nitrided as shown in FIGS. 3 and 4. This is a result of pre-treatment of this sample in a solution of phosphine in hexane, which created a higher phosphorus potential on the surface of the sample. This phosphorus potential was higher than the sulfur potential to form a chemisorbed monolayer and the sulfur potential to form sulfides.

The absence of traces of sulfur on the surfaces of all the samples, despite the fact that 20 ppm of $H_2S$ was present in the atmosphere, demonstrated that phosphorus deposited on the surface of the metal repels sulfur and prevents it from being deposited on the metal surface. Therefore, the formation of metal sulfides and their deposition on the surfaces is substantially completely prevented or inhibited.

From the results presented above, it follows that it is possible to effectively prevent nitridation by adding to an ammonia containing atmosphere a small quantity of sulfur-containing compounds which will deactivate the catalytic activity of the metal surface to nitridation. At the same time, it is possible to prevent sulfidation corrosion, which could be caused by the introduction of sulfur into the atmosphere, by adding a measured quantity of phosphorus-containing compounds to the atmosphere.

Figure 7:
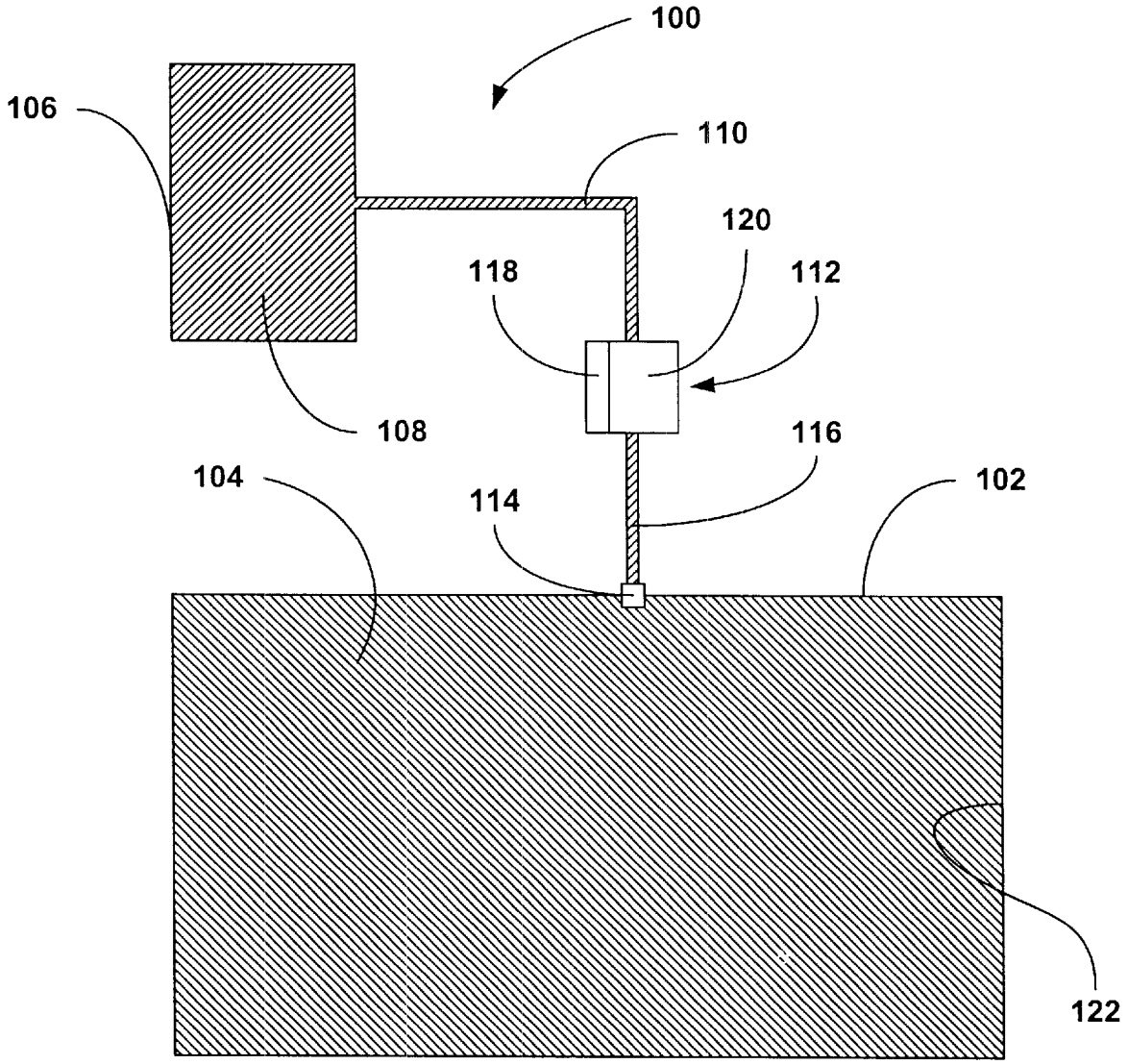
FIG. 7 a schematic block diagram of one embodiment of a system of introducing the nitridation inhibitors of the present invention into a piece of equipment having interior metal surfaces in contact with a fluid containing a nitrogen-containing compound.
Figure 8:
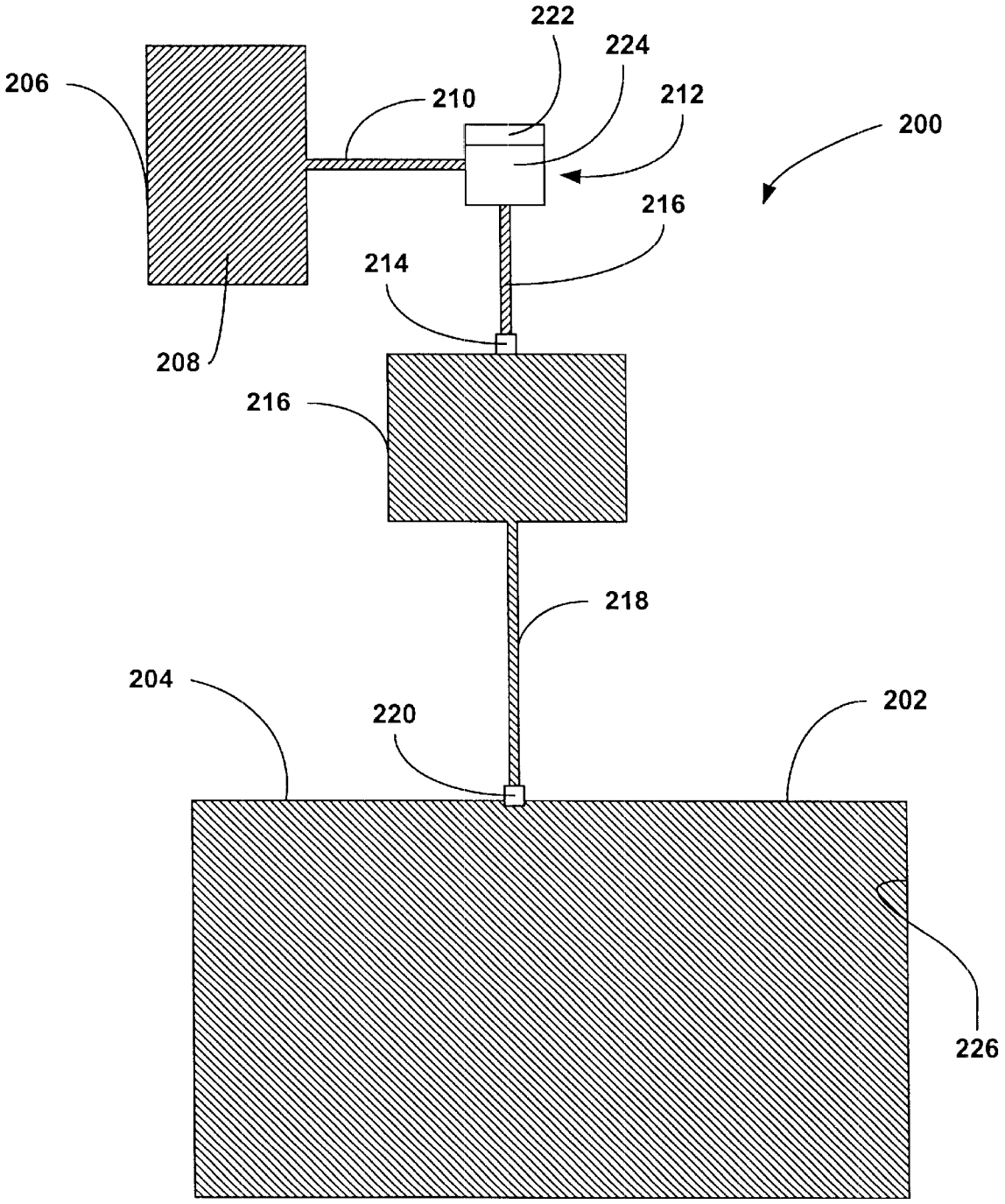
FIG. 8 a schematic block diagram of another embodiment of a system of introducing the nitridation inhibitors of the present invention into a piece of equipment having interior metal surfaces in contact with a fluid containing a nitrogen-containing compound.

Reference is now drawn to the FIGS. 7–8 which are included for purposes of illustrating apparatuses that can be used to introduce a preventative composition of the present invention and are not meant to be restrictive or limiting as to the scope of this application or the manner in which the compositions of the present invention can be introduced into equipment to be protected against nitridation and/or carburization.

Referring now to FIG. 7, a system, generally 100 is shown for introducing a nitridation/carburization preventative composition of the present invention into a closed metal vessel 102 containing a fluid containing a water-ammonia mixture 104. The system includes a reservoir 106 containing a nitridation/carburization preventative composition 108 of the present invention, a conduit 110 connecting the reservoir 106 to a metering unit 112 connected to an inlet valve 114 attached to the vessel 102 by a second conduit 116. The metering unit 112 includes a controller 118 and a pump 120 (as is well-known in the art), which injects the nitridation/carburization preventative composition 108 under controlled conditions into the vessel 102 at a rate sufficient to maintain a concentration of the nitridation/carburization preventative composition 108 in the fluid 104 sufficient to reduce or prevent nitridation and/or carburization of interior surfaces 122 of the vessel.

Referring now to FIG. 8, another system, generally 200 is shown for introducing a nitridation/carburization preventative composition of the present invention into a closed metal vessel 202 containing a fluid containing a water-ammonia mixture 204. The system includes a reservoir 206 containing a nitridation/carburization preventative composition 208 of the present invention, a conduit 210 connecting the reservoir 206 to a metering unit 212 connected to an inlet valve 214 attached to a water-ammonia reservoir 216, which is in turn connected by a second conduit 218 to a valve 220 attached to the vessel 202. The metering unit 212 includes a controller 222 and a pump 224 which injects the nitridation/carburization preventative composition 208 under controlled conditions into the water-ammonia reservoir 216 at a rate sufficient to maintain a concentration of the nitridation/carburization preventative composition 208 in the fluid 204 sufficient to reduce or prevent nitridation and/or carburization of interior surfaces 226 of the vessel.

All references cited herein are incorporated by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

I claim:

1. A method of preventing nitridation or caburization of metals comprising the steps of:

adding to a fluid including a nitriding compound or a carburizing compound an effective amount of a preventative composition an effective amount of a sulfur-containing material to reduce nitridation or carburization of the metal and an effective amount of a phosphorus-containing material to reduce sulfidation of the metal without interfering with the sulfur-containing materials ability to prevent nitridation or carburization, where the composition reduces or prevents nitridation or carburization by deactivating metal sites involved in the formation of atomic nitrogen or atomic carbon on or at a surface of the metal.

2. A method of preventing nitridation of metals comprising the steps of:

adding to a fluid including a nitrogen-containing compound capable of nitriding a metal surface an effective amount of a preventative composition comprising an effective amount of a sulfur-containing material to reduce nitridation of the metal and an effective amount of a phosphorus-containing material to reduce sulfidation of the metal without interfering with the sulfur-containing materials ability to prevent nitridation, where the composition reduces or prevents nitridation by deactivating catalytic metal sites involved in the formation of atomic nitrogen on or at a surface of the metal or deactivating the metal surface.

3. A method of preventing carburization of metals comprising the steps of:

adding to a fluid including a carbon-containing compound capable of carburizing a metal surface an effective amount of a preventative composition comprising an effective amount of a sulfur-containing material to reduce carburization of the metal and an effective amount of a phosphorus-containing material to reduce sulfidation of the metal without interfering with the sulfur-containing materials ability to prevent carburization, where the composition reduces or prevents carburization by deactivating metal sites involved in the formation of atomic carbon on or at a surface of the metal or deactivating the metal surface.

4. A metal surface treated with a composition comprising an effective amount of a preventative composition comprising an effective amount of a sulfur-containing material to reduce nitridation or carburization of the metal and an effective amount of a phosphorus-containing material to reduce sulfidation of the metal without interfering with the sulfur-containing materials ability to prevent nitridation or carburization, where the composition reduces or prevents nitridation or carburization by deactivating metal sites involved in the formation of atomic nitrogen or carbon on or at a surface of the metal.

5. An apparatus comprising a reservoir containing nitridation or carburization preventative composition comprising an effective amount of a sulfur-containing material to reduce nitridation or carburization of the metal and an effective amount of a phosphorus-containing material to reduce sulfidation of the metal without interfering with the sulfur-containing materials ability to prevent nitridation or carburization and an introduction system, in fluid communication with the reservoir and an interior of a container having metal surfaces in contact with a fluid capable of nitriding or carburizing the metal surfaces, for introducing an effective amount of the composition into the container to prevent nitridation and carburization.

6. The method, surface or apparatus of claims 1–5, wherein the composition comprises a material having a higher affinity for the metal surface than the nitriding compound or carburizing compound.

7. The method, surface or apparatus of claims 1–5, wherein the effective amount of the sulfur-containing material is between about 5 ppm and about 50 ppm and the effective amount of the phosphorus-containing material is between about 0.01 and about 10 ppm.

8. The method, surface or apparatus of claims 1–5, wherein the effective amount of the sulfur-containing material is between about 10 ppm and about 40 ppm and the effective amount of the phosphorus-containing material is between about 0.05 ppm and about 5 ppm.

9. The method, surface or apparatus of claims 1–5, wherein the effective amount of the sulfur-containing material is between about 15 ppm and about 25 ppm and the effective amount of the phosphorus-containing material is between about 0.05 ppm and about 2 ppm.

10. The method, surface or apparatus of claims 1–5, wherein the effective amount of the sulfur-containing material is between about 5 ppm and the effective amount of the phosphorus-containing material is between about 0.1 ppm to about 1 ppm.

11. The method, surface or apparatus of claims 1–5, wherein the sulfur-containing material is selected from the group consisting of: sulfur; hydrogen sulfide; sulfide salts selected from the group consisting of ammonium sulfide, alkali metal sulfides, alkaline metal sulfides and sulfides having organic counter ions; thiols of formula RSH where R is a C1 to C20 carbon-containing group including alkyl, aryl, alkaryl or aralkyl; disulfides having of formula RSSR where each R is the same or different and is a C1 to C20 carbon-containing group including alkyl, aryl, alkaryl or aralkyl; disulfide salts of formula RSSZ where R is a C1 to C20 carbon-containing group including alkyl, aryl, alkaryl or aralkyl and Z is ammonium, an alkali metal, an alkaline metal or an organic counterion; polysulfides of formula $RS_iR$ where each R is the same or different and is a C1 to C20 carbon-containing group including alkyl, aryl, alkaryl or aralkyl and i is an integer having a value greater than 2 and less than about 20; polysulfide salts of formula $RS_iZ$ where R is a C1 to C20 carbon-containing group including alkyl, aryl, alkaryl or aralkyl, i is an integer having a value greater than 2 and less than about 20 and Z is ammonium, an alkali metal, an alkaline metal or an organic counterion; or other sulfur compounds capable of sulfidizing a metal surface; and mixtures or combinations thereof.

12. The method, surface or apparatus of claims 1–5, wherein the phosphorus-containing material is selected from the group consisting of: phosphorus; phosphines of formulas $PH_3$, $PRH_2$, $PR_2H$, and $R_3P$ where each R is the same or different and is a C1 to C20 carbon-containing group including alkyl, aryl, alkaryl or aralkyl; ammonium phosphites; alkali metal phosphites; alkaline metal phosphites; phosphites having organic counter ions; ammonium phosphates; alkali metal phosphates; alkaline metal phosphates; phosphates having organic counter ions; ammonium pyrophosphates; alkali metal pyrophosphates; alkaline metal pyrophospates; pyrophospates having organic counter ions; ammonium polyphosphates; alkali metal polyphosphates; alkaline metal polyphosphates; polyphosphates having organic counter ions; or other phosphorus-containing compounds capable of inhibiting sulfuric corrosion of metal surfaces; and mixtures or combinations thereof.

13. The method, surface or apparatus of claims 1–5, wherein the sulfur-containing material and the phosphorus-containing material are selected from the group consisting of thiophosphates, thiophoshites, or other compounds-containing phosphorus and sulfur which act to inhibit nitridation of metal surfaces in contact with a fluid containing a nitrogen-containing compound capable of nitriding the metal surfaces, and mixtures or combinations thereof.

14. A method of preventing nitridation of metals comprising the steps of:

adding to a fluid including a nitrogen-containing compound capable of nitriding a metal surface an effective amount of a sulfur-containing material to rapidly form a partial or complete monolayer of the compound on a portion of the metal surface in contact with the fluid and an effective amount of a phosphorus-containing material to inhibit sulfidation of the surface, where the sulfur-containing material substantially prevents nitridation and the phosphorus-containing material substantially reduces sulfidation without interfering with the nitridation preventative action of the sulfur-containing compound.

15. The method of claim 14, wherein the sulfur-containing material is selected from the group consisting of: sulfur, hydrogen sulfide; sulfide salts selected from the group consisting of ammonium sulfide, alkali metal sulfides, alkaline metal sulfides and sulfides having organic counter ions; thiols of formula RSH where R is a C1 to C20 carbon-containing group including alkyl, aryl, alkaryl or aralkyl; disulfides having of formula RSSR where each R is the same or different and is a C1 to C20 carbon-containing group including alkyl, aryl, alkaryl or aralkyl; disulfide salts of formula RSSZ where R is a C1 to C20 carbon-containing group including alkyl, aryl, alkaryl or aralkyl and Z is ammonium, an alkali metal, an alkaline metal or an organic counterion; polysulfides of formula $RS_iR$ where each R is the same or different and is a C1 to C20 carbon-containing group including alkyl, aryl, alkaryl or aralkyl and i is an integer having a value greater than 2 and less than about 20; polysulfide salts of formula $RS_iZ$ where R is a C1 to C20 carbon-containing group including alkyl, aryl, alkaryl or aralkyl, i is an integer having a value greater than 2 and less than about 20 and Z is ammonium, an alkali metal, an alkaline metal or an organic counterion; or other sulfur compounds capable of sulfidizing a metal surface; and mixtures or combinations thereof and the phosphorus-containing material is selected from the group consisting of: phosphorus; phosphines of formulas $PH_3$, $PRH_2$, $PR_2H$, and $R_3P$ where each R is the same or different and is a C1 to C20 carbon-containing group including alkyl, aryl, alkaryl or aralkyl; ammonium phosphites; alkali metal phosphites; alkaline metal phosphites; phosphites having organic counter ions; ammonium polyphosphates; alkali metal polyphosphates; alkaline metal polyphosphates; polyphosphates having organic counter ions; or other phosphorus-containing compounds capable of inhibiting sulfuric corrosion of metal surfaces; and mixtures or combinations thereof and the effective amount of the sulfur-containing material is between about 5 ppm and about 50 ppm and the effective amount of the phosphorus-containing material is between about 0.01 and about 10 ppm.

16. A method of preventing carburization of metals comprising the steps of:

adding to a fluid including a carbon-containing compound capable of carburizing a metal surface an effective amount of a sulfur-containing material to rapidly form a partial or complete monolayer of the material on a portion of the metal surface in contact with the fluid and an effective amount of a phosphorus-containing material to inhibit sulfidation of the surface, where the sulfur-containing material substantially prevents carburization and the phosphorus-containing material substantially reduces sulfidation without interfering with the carburization preventative action of the sulfur-containing material.

17. The method of claim 16, wherein the sulfur-containing material is selected from the group consisting of: sulfur; hydrogen sulfide; sulfide salts selected from the group consisting of ammonium sulfide, alkali metal sulfides, alkaline metal sulfides and sulfides having organic counter ions; thiols of formula RSH where R is a C1 to C20 carbon-containing group including alkyl, aryl, alkaryl or aralkyl; disulfides having of formula RSSR where each R is the same or different and is a C1 to C20 carbon-containing group including alkyl, aryl, alkaryl or aralkyl; disulfide salts of formula RSSZ where R is a C1 to C20 carbon-containing group including alkyl, aryl, alkaryl or aralkyl and Z is ammonium, an alkali metal, an alkaline metal or an organic counterion; polysulfides of formula $RS_iR$ where each R is the same or different and is a C1 to C20 carbon-containing group including alkyl, aryl, alkaryl or aralkyl and i is an integer having a value greater than 2 and less than about 20; polysulfide salts of formula $RS_iZ$ where R is a C1 to C20 carbon-containing group including alkyl, aryl, alkaryl or aralkyl, i is an integer having a value greater than 2 and less than about 20 and Z is ammonium, an alkali metal, an alkaline metal or an organic counterion; or other sulfur compounds capable of sulfidizing a metal surface; and mixtures or combinations thereof and the phosphorus-containing material is selected from the group consisting of: phosphorus; phosphines of formulas $PH_3$, $PRH_2$, $PR_2H$, and $R_3P$ where each R is the same or different and is a C1 to C20 carbon-containing group including alkyl, aryl, alkaryl or aralkyl; ammonium phosphites; alkali metal phosphites; alkaline metal phosphites; phosphites having organic counter ions; ammonium phosphates; alkali metal phosphates; alkaline metal phosphates; phosphates having organic counter ions; ammonium pyrophosphates; alkali metal pyrophosphates; alkaline metal pyrophosphates; pyrophosphates having organic counter ions; ammonium polyphosphates; alkali metal polyphosphates; alkaline metal polyphosphates; polyphosphates having organic counter ions; or other phosphorus-containing compounds capable or inhibiting sulfuric corrosion of metal surfaces; and mixtures or combinations thereof and the effective amount of the sulfur-containing material is between about 5 ppm and about 50 ppm and the effective amount of the phosphorus-containing material is between about 0.01 and about 10 ppm.

* * * * *